US009476281B2

(12) United States Patent
Lundgard

(10) Patent No.: US 9,476,281 B2
(45) Date of Patent: Oct. 25, 2016

(54) HIGH PRESSURE SWELL SEAL

(71) Applicant: Halliburton Energy Services, Inc., Houston, TX (US)

(72) Inventor: Geir Lundgard, Rogland (NO)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/889,409

(22) PCT Filed: Jun. 20, 2013

(86) PCT No.: PCT/US2013/046905

§ 371 (c)(1),
(2) Date: Nov. 5, 2015

(87) PCT Pub. No.: WO2014/204478

PCT Pub. Date: Dec. 24, 2014

(65) Prior Publication Data

US 2016/0130907 A1 May 12, 2016

(51) Int. Cl.
*E21B 33/128* (2006.01)
*E21B 33/12* (2006.01)
*E21B 33/127* (2006.01)

(52) U.S. Cl.
CPC ..... *E21B 33/1285* (2013.01); *E21B 33/127* (2013.01); *E21B 33/1208* (2013.01)

(58) Field of Classification Search
CPC ..... E21B 33/1208; E21B 22/1285; E21B 33/1277
See application file for complete search history.

(56) References Cited

U.S. PATENT DOCUMENTS 4,349,204 A * 9/1982 Malone ..... E21B 33/1216 166/120
7,806,193 B2 * 10/2010 Berzin ..... E21B 33/1208 166/132
7,849,930 B2 12/2010 Chalker et al.
8,360,161 B2 1/2013 Buytaert et al.
2009/0229816 A1 9/2009 Lemme et al.
2010/0307771 A1 * 12/2010 McRobb ..... E21B 33/1208 166/387
2012/0145412 A1 6/2012 Andersen
2015/0129242 A1 * 5/2015 Farquhar ..... E21B 23/06 166/387

(Continued)

FOREIGN PATENT DOCUMENTS

NL WO 2015032553 A2 * 3/2015 ..... E21B 33/1208
WO WO 2008036553 3/2008
WO WO 2013/079965 6/2013

OTHER PUBLICATIONS

PCT International Preliminary Report on Patentability, PCT/US2013/046905, Dec. 30, 2015, 6 pages.

(Continued)

*Primary Examiner* — James G Sayre
(74) *Attorney, Agent, or Firm* — Scott Richardson Parker Justiss, P.C.

(57) ABSTRACT

A well tool for sealing an annular gap between a tubing string and a wellbore wall is described. In one implementation, the well tool includes an annular inner seal, an annular sleeve disposed over the inner seal, an annular outer seal residing over the sleeve and comprising a swellable elastomer adapted to swell when contacted by a specified fluid, the annular outer seal being axially shorter than the sleeve, and an end ring adapted to be disposed at an end of the sleeve, the sleeve configured to buckle against the end ring in response to a deformation of the outer seal due to directional pressure.

18 Claims, 3 Drawing Sheets

(56) References Cited

U.S. PATENT DOCUMENTS

2015/0308228 A1* 10/2015 Vick, Jr. ..... E21B 43/12
166/373
2016/0053570 A1* 2/2016 Andersen ..... E21B 33/1208
166/192

OTHER PUBLICATIONS

International Search Report and Written Opinion of the International Searching Authority issued in International Application No. PCT/US2013/046905 on Mar. 14, 2014; 9 pages.

* cited by examiner

HIGH PRESSURE SWELL SEAL

CROSS-REFERENCE TO RELATED APPLICATIONS

This application is a 371 U.S. National Phase Application of and claims the benefit of priority to International Application No. PCT/US2013/046905, filed Jun. 20, 2013, the entire contents of which are hereby incorporated by reference.

TECHNICAL FIELD

This disclosure relates to sealing high pressure in a well bore with a swellable seal.

BACKGROUND

In subterranean wells, such as those for oil and gas production, swell seal tools may be used to seal portions of a wellbore. Some swell seal tools may be configured to seal the well bore in response to (i.e., contact with) a certain fluid or chemical.

DETAILED DESCRIPTION

In certain implementations, an example swell seal tool includes an end ring, an annular inner seal, an annular sleeve, and an annular outer seal including a swellable elastomer. The swell tool may be disposed around a tubing string or can be provided with a base pipe that couples inline in a tubing string to be placed into a wellbore. The outer seal is adapted to swell when contacted by a specified fluid to substantially seal an annular gap between the swell seal tool and the wall of the wellbore. During operation, directional pressure within the wellbore may cause deformation of the outer seal (e.g., extrusion), which can lead to leakage between the outer seal and the wellbore wall and failure of the example swell seal tool. However, the sleeve of the example swell seal tool is buckled against the end ring by the directional pressure, causing the sleeve to deform into a position that reinforces the outer seal and limit deformation of the outer seal.

Swell seal tools according to the various aspects of the present disclosure may realize various advantages including increased pressure and/or temperature capacity. In certain instances, due to the simplicity of the configuration, the increased pressure and/or temperature capacity can come without a significant increase in manufacturing cost. In certain instances, the concepts herein enable the use of swell seal tools in larger annular gaps with a minimum of seal extrusion. The swell seal tool may also exhibit increased durability with respect to other designs.

Figure 1:
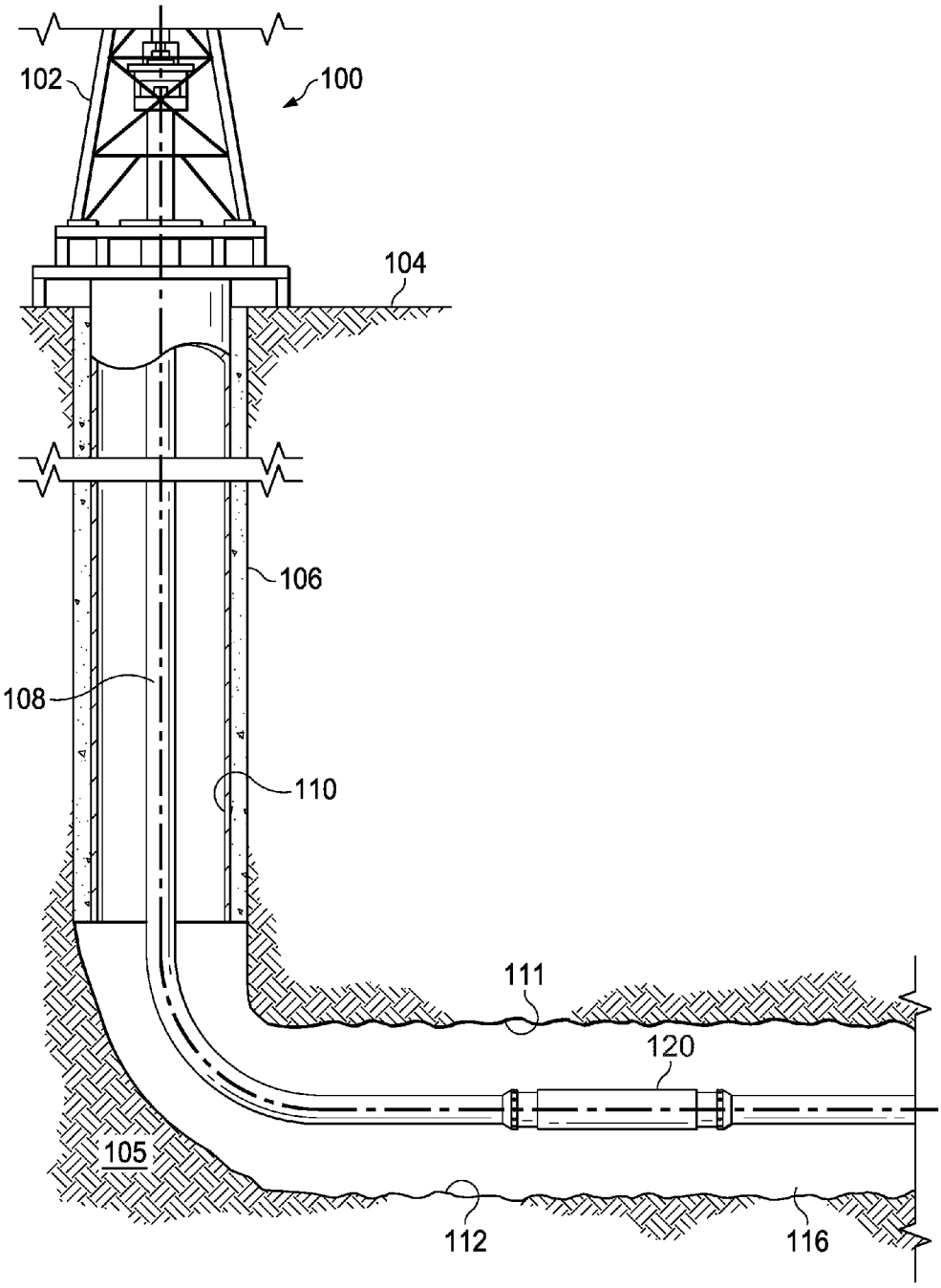
FIG. 1 illustrates a wellbore including a high pressure swell seal tool.

FIG. 1 illustrates a well 100 including a high pressure swell seal tool. The well 100 includes a wellhead 102 disposed at the terranean surface 104. A wellbore 106 extends downward from the wellhead 102 through subterranean zone 105. As shown, the wellbore 106 includes a cased portion 110, and an uncased portion 111. The cased portion 110 may include casing affixed to the walls of the wellbore 106. The wellbore 106 also includes a deviated portion 112. Other configurations of wellbores are within the concepts herein.

A tubing string 108 extends downward from the wellhead 102 into the wellbore 106. A swell seal tool 120 having a swellable seal element threaded in-line in the tubing string 108. The swell seal tool 120 can be configured as a packer, a bridge plug, a frac plug and/or another type of tool that includes a swellable seal element. Although shown as threaded in-line in the tubing string 108, in other instances, the swell seal tool 120 can be disposed around the tubing string 108 (e.g., in a slip-on configuration). Also, in other instances, the swell seal tool 120 can be carried in the well on wire (e.g., wireline, slickline and/or other).

In operation, the seal element of the swell seal tool 120 swells to fill the annular gap 116 between the swell seal tool 200 and the wall of the wellbore 106 and seal against passage of fluids (liquid and/or gas). The swelling is in response to the presence of (i.e., contact with) a specified fluid or substance within the wellbore. In certain instances, the specified fluid can be oil, water and/or other fluids. The swell tool 200 includes a sleeve configured to buckle, forming radially extending folds that reinforce and limit deformation of the swell tool's swellable seal element.

Figure 2A:
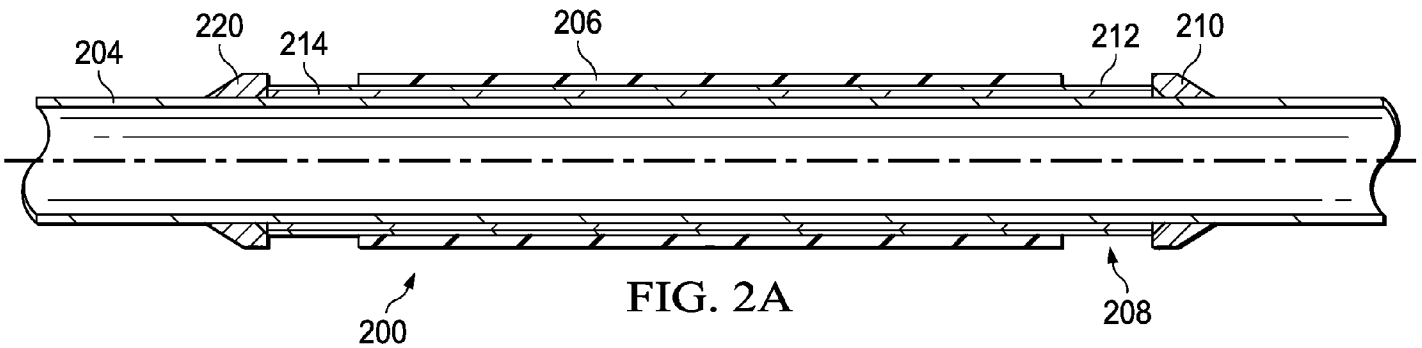
FIG. 2A is a half cross sectional view of an example swell seal tool for sealing an annular gap between a tubing string and a wellbore wall.

FIG. 2A is a half cross sectional view of an example swell seal tool 200 for sealing an annular gap between a tubing string 204 and a wellbore wall. The example swell seal tool 200 can be used as swell tool 120. The example swell seal tool 200 includes an annular inner seal 214, an annular sleeve 212 disposed over the inner seal 214, and an annular outer swellable seal 206 residing over the sleeve 212. The annular sleeve 212 is affixed to the outer seal 206 and/or the inner seal 214. The outer seal 206 of the example swell seal tool 200 is axially shorter than the sleeve 212, leaving an axial gap 208 between the outer seal 206 and the end ring 210. The example swell seal tool 200 also includes an end ring 210 adapted to be disposed at an end of the sleeve 212, and an end ring 220 adapted to be disposed at an opposite end of the sleeve 212 from the end ring 210.

In some implementations, the inner seal 214, the sleeve 212, the outer seal 206, and the end rings 210, 220 are provided on a base pipe that couples in-line (threadingly and/or otherwise) with the remainder of the tubing string 204. In such cases, the end rings 210, 220 can be affixed to the base pipe (e.g., by welding and/or otherwise). In some implementations, the swell seal tool 200 is a slip-on configuration, where the inner seal 214, the sleeve 212, the outer seal 206 and the end rings 210, 220 slip on over a tubular in a tubing string 204. In such cases, the end rings 210, 220 can have set screws and/or another mechanism to anchor them to the tubing string 204.

The sleeve 212 of the example swell seal tool 200 is adapted to buckle against the end ring 210 in response to a directional pressure. In some implementations, this buckling of the sleeve 212 results from the sleeve sliding axially relative to the tubing string 204. The buckling may cause the sleeve 212 to fold and extend radially relative to the tubing string 204. In this buckled state, the sleeve 212 provides support for the outer seal 206, thereby limiting extrusion of the outer seal 206 in the direction of the directional pressure.

In some instances, the sleeve 212 is made of a metal and/or other material that can plastically deform as buckled without substantially breaking. The sleeve 212 may also be made of any material configured to buckle in the manner described herein, and configured to provide sufficient rigidity in a buckled state to limit the extrusion of the outer seal 206.

The inner seal 214 of the example swell seal tool 200 is disposed beneath the sleeve 212. In some implementations, the inner seal 214 is composed of a swellable elastomer adapted to swell when contacted by a specified fluid. One or both of the inner seal 214 and outer seal 206 are adapted to slide axially relative the tubing string 204 (along with the sleeve 212) in response to a directional pressure.

One or both of the end rings 210, 220 are adapted to retain the sleeve 212 axially when the sleeve 212 slides in response to directional pressure.

As noted above, the example swell tool 200 also includes a gap 208 between the outer seal 206 and the end ring 210. The buckling of sleeve 212 occurs in this gap 208. In some instances, the size of the gap 208 may be chosen based on the size of the annular gap between the swell seal tool 200 and the wellbore wall. For example, the size of the gap 208 may be chosen to produce a certain buckling radius of the sleeve 212 against the end ring 210, such that the buckling radius is sufficient to provide support for the outer seal 206 against the directional pressure. In certain instances, the gap 208 is selected to produce a buckling radius such that the buckled sleeve 212 contacts the wall sealed against by the outer seal 206.

Figure 2B:
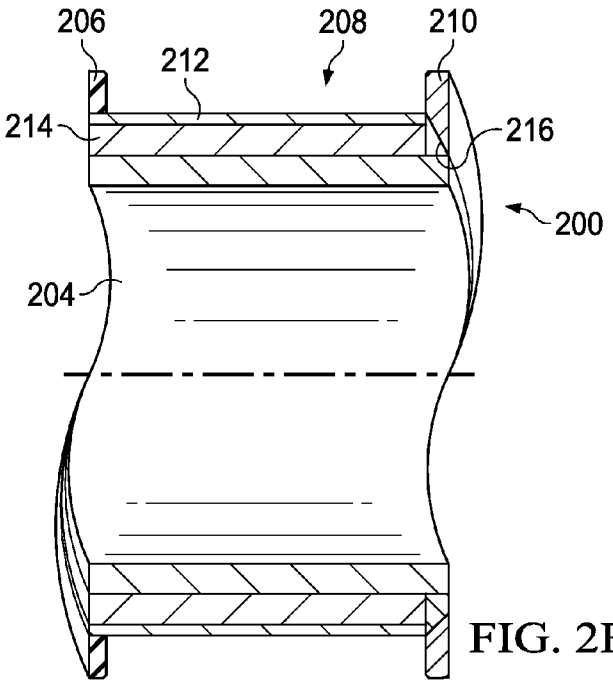
FIG. 2B is a detail, half cross sectional view of a portion of the high pressure swell seal tool from FIG. 2A.

FIG. 2B is a detail, half cross sectional view of a portion of the swell seal tool 200 from FIG. 2A. The illustrated view provides more detail on the area around the gap 208 between the outer seal 206 and the end ring 210. As shown, the end ring 210 includes a recess 216 disposed at the end of the end ring 210 closest to the tubing string 204. The recess 216 is configured to receive an end of the sleeve 212 when the sleeve slides axially in response to directional pressure. The end of the sleeve 212 becomes lodged in the recess 216, causing the sleeve 212 to buckle in response to continued directional pressure (shown in FIG. 3B). In some implementations, the recess is a chamfer. The recess may also be a notch, catch, groove, channel, and/or any other structure for receiving the end of the sleeve 212. Although, FIG. 2B shows end ring 210 having the recess 216, one or both of the end rings 210, 220 can be provided with the recess 216 and/or another configuration to receive an end of the sleeve 212 when the sleeve 212 buckles.

Figure 3A:
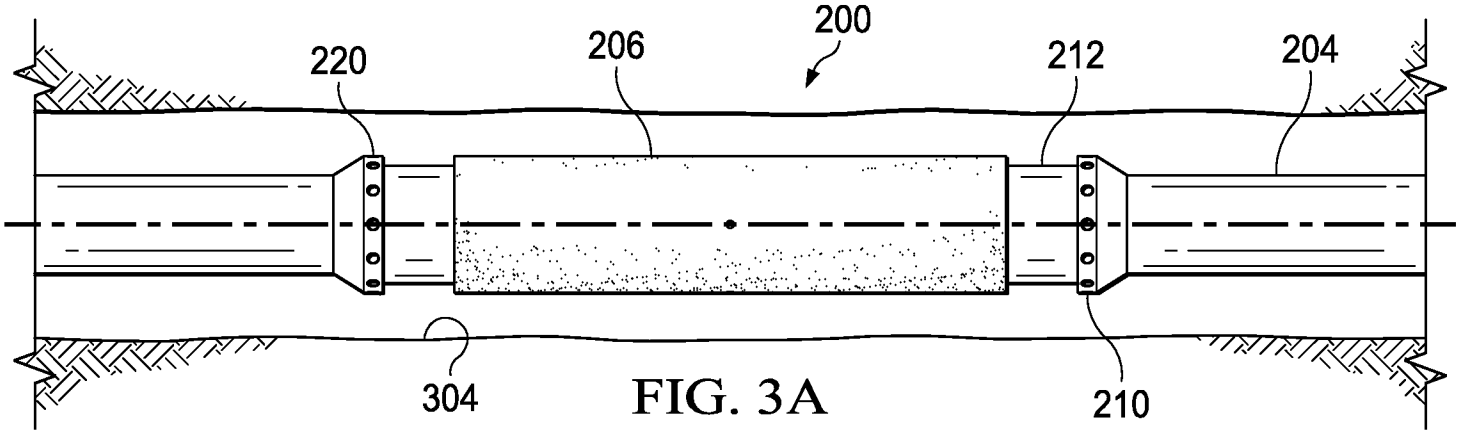
FIG. 3A is a side view of the high pressure swell seal tool prior to an application of directional pressure.

FIG. 3A illustrates the swell seal tool 200 in a wellbore 304 prior to sealing with the wall of the wellbore 304 (e.g., a casing, a liner, bare rock and/or other) and thus prior to an application of directional pressure. Note the position of the outer seal 206 spaced from the wall of the wellbore 304 and centered between the end rings, and the sleeve 212 not buckled, abutting the end rings.

Figure 3B:
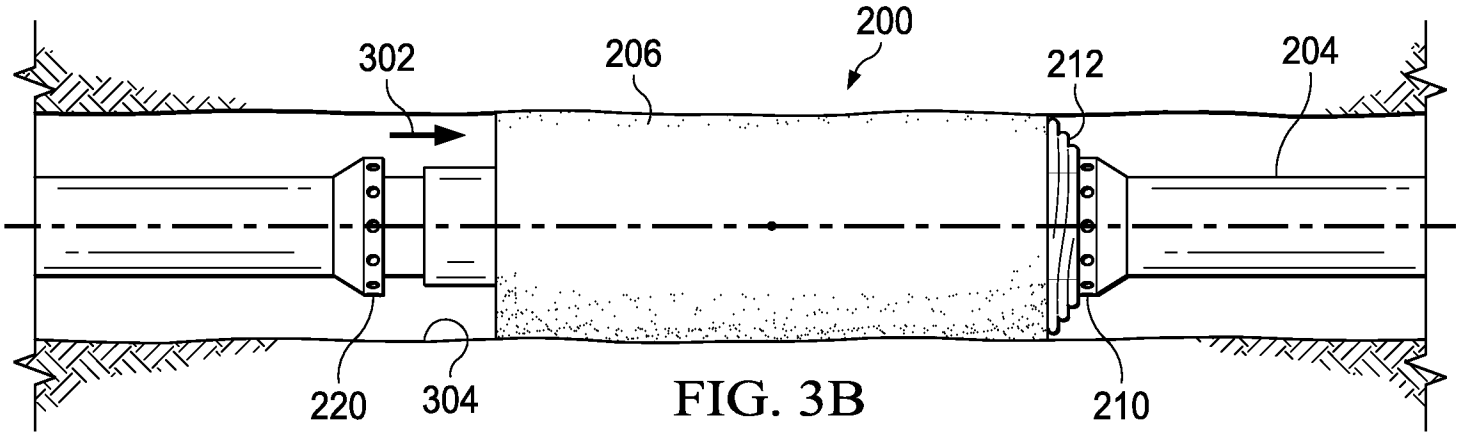
FIG. 3B is a side view of the high pressure swell seal tool after an application of directional pressure.

FIG. 3B illustrates the swell seal tool 200 after the outer seal 206 has been contacted with the specified fluid and caused to radially expand to abut and seal (substantially or entirely gas and/or liquid tight) with the wall of the wellbore 304, and thus seal the annulus between the tubing string 204 and the wellbore. The swell tool 200 is subjected to an application of directional pressure in the direction indicated by arrow 302 (with higher pressure at the left of the figure). The directional pressure has caused the outer seal 206, sleeve 212 and inner seal of the swell seal tool 200 to shift axially along the tubing string 204 in the direction of the directional pressure indicated by the arrow 302. The shifting of the outer seal 206, sleeve 212 and inner seal causes the sleeve 212 to buckle against the end ring 210.

As shown, the folds formed as the sleeve 212 buckles extend radially outwards from the tubing string 204. The buckling of the sleeve 212 produces radial folds in the sleeve. The outer seal 206 abuts the radial folds of the sleeve 212, which provide support for the outer seal 206 against the directional pressure 302. In some implementations, the sleeve 212 is configured such that the radial folds in the buckled state substantially fill an annular gap between the swell seal tool 200 and the wellbore wall 304. The folds can abut the wellbore wall 304 and prevent extrusion of the outer seal 206 through the annular gap. The sleeve 212 is made of a stronger, stiffer material than the outer seal 206, and thus able to hold against a higher pressure than the outer seal 206 alone. Moreover, the folds of the sleeve 212 increase the stiffness of the sleeve 212 in supporting the outer seal 206.

A number of implementations have been described. Nevertheless, it will be understood that additional modifications may be made. Accordingly, other implementations are within the scope of the following claims.

What is claimed is:

1. A well tool for sealing an annular gap between a tubing string and a wellbore wall, the well tool comprising:

an annular inner seal;

an annular sleeve disposed over the inner seal;

an annular outer seal residing over the sleeve and comprising a swellable elastomer adapted to swell when contacted by a specified fluid, the annular outer seal being axially shorter than the sleeve; and an end ring adapted to be disposed at an end of the sleeve, the sleeve configured to buckle against the end ring in response to sliding of the outer seal due to directional pressure.

2. The well tool of claim 1, wherein the inner seal, the sleeve, the outer seal, and the end ring are disposed annular to a base pipe of the tubing string.

3. The well tool of claim 1, wherein the end ring comprises a recess configured to receive an end of the sleeve when the sleeve is in a buckled state.

4. The well tool of claim 3, wherein the recess is a chamfer.

5. The well tool of claim 1, wherein the sleeve is configured to have an amplitude substantially filling the annular gap when the sleeve is buckled against the end ring.

6. The well tool of claim 1, wherein the sleeve is made of metal.

7. The well tool of claim 1, wherein the inner seal comprises a swellable elastomer adapted to swell when contacted by a specified fluid, and the inner seal and the outer seal are configured to swell when contacted by the same fluid.

8. The well tool of claim 7, wherein the inner seal and the outer seal are formed from the same material.

9. A method for sealing an annular gap between a tubing string and a wellbore wall, the method comprising:

swelling an elastomer in response to a presence of a specified fluid, the swelling substantially filling the annular gap;

sliding the elastomer along the tubing string in response to a directional pressure; and buckling a sleeve against an end ring in response to sliding the elastomer, the buckling providing support to lessen deformation of the elastomer in response to the directional pressure.

10. The method of claim 9, wherein buckling the sleeve against the end ring includes receiving an end of the sleeve into a recess in the end ring.

11. The method of claim 10, wherein the recess is a chamfer.

12. The method of claim 9, wherein buckling a sleeve against an end ring in response to sliding the elastomer comprises buckling the sleeve to substantially fill the annular gap.

13. The method of claim 9, wherein the sleeve is made of metal.

14. A device for sealing an annular gap between a tubing string and a wellbore wall, the device comprising:

an elastomer configured to swell in response to a presence of a specified fluid, the swelling substantially filling the annular gap, the elastomer configured to slide along the tubing string in response to a directional pressure; and a sleeve configured to buckle against an end ring in response to sliding of the elastomer, the buckling providing support to lessen deformation of the elastomer in response to the directional pressure.

15. The device of claim 14, wherein buckling the sleeve against the end ring includes receiving an end of the sleeve into a recess in the end ring.

16. The device of claim 15, wherein the recess is a chamfer.

17. The device of claim 14, wherein the sleeve is configured to have an amplitude substantially filling the annular gap when the sleeve is buckled against the end ring.

18. The device of claim 14, wherein the sleeve is made of metal.

* * * * *